US008328331B2

(12) United States Patent
Gulvin et al.

(10) Patent No.: US 8,328,331 B2
(45) Date of Patent: Dec. 11, 2012

(54) INK JET PRINT HEAD PLATE

(75) Inventors: Peter M. Gulvin, Webster, NY (US); Andrew W. Hays, Fairport, NY (US); James M. Casella, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 218 days.

(21) Appl. No.: 12/727,445

(22) Filed: Mar. 19, 2010

(65) Prior Publication Data

US 2011/0228005 A1 Sep. 22, 2011

(51) Int. Cl.
*B41J 2/14* (2006.01)

(52) U.S. Cl. ..... 347/47

(58) Field of Classification Search ..... 347/47, 347/112

See application file for complete search history.

(56) References Cited

U.S. PATENT DOCUMENTS

2005/0280680 A1* 12/2005 Hess et al. ..... 347/92
2007/0103524 A1* 5/2007 Ito ..... 347/92
2007/0273726 A1* 11/2007 Rosenblum et al. ..... 347/47
2008/0238997 A1* 10/2008 Nystrom et al. ..... 347/41

OTHER PUBLICATIONS

PDF Article "Surface Tension", p. 1, paragraphs 1-3.*

* cited by examiner

*Primary Examiner* — Matthew Luu
*Assistant Examiner* — Lisa M Solomon
(74) *Attorney, Agent, or Firm* — MH2 Technology Law Group LLP

(57) ABSTRACT

A nozzle plate for an inkjet printhead, the nozzle plate including a nozzle through which ink is ejected, the nozzle optimally positioned in the nozzle plate. The nozzle plate further including at least one priming hole, the priming hole distinct from and of a smaller diameter than the nozzle, the priming holes positioned at selected locations of the nozzle plate to purge air from the ink jet print head.

19 Claims, 3 Drawing Sheets

INK JET PRINT HEAD PLATE

FIELD OF THE INVENTION

This invention relates generally to imaging and, more particularly, to a printhead plate having priming holes to allow freedom of nozzle placement and reduced purge volume in an ink jet print head.

BACKGROUND OF THE INVENTION

In order to properly prime an inkjet printhead (during initial filling, after de-priming, or due to air ingestion), the incoming ink must displace all the air in the ink cavity, because residual air bubbles create a condition in the system that disrupts jetting. Instead of the generated pressure pulse being used to create drops, a large portion of it is absorbed by the volume change of air bubbles. This places extra constraints on the nozzle placement, because all of the air must escape before the liquid reaches the nozzle and blocks the nozzle. If, for example, the ink cavity is long and narrow, the nozzle would have to be placed near the very distant end, or else an air bubble will be trapped at the dead end. Typically, this location of the nozzle is not the optimal position for the nozzle. Also, if the nozzle is placed in a position where clearing the air out is difficult, large purge masses are required to get out all of the air. Large purge masses waste expensive ink, thereby making the nozzle position undesirable.

It would, therefore, be desirable to facilitate the purging of air from the internal ink path without interfering with optimal nozzle placements.

SUMMARY OF THE INVENTION

According to various embodiments, the present teachings include a nozzle plate for an ink jet printhead.

The nozzle plate includes nozzle holes through which ink is ejected, the nozzle holes positioned at a distance anywhere in the nozzle plate; and a priming hole, distinct from and of a smaller diameter than the nozzle holes, the priming hole positioned at a position in the nozzle plate to purge air from an ink cavity of the jet print head.

Additional advantages of the invention will be set forth in part in the description which follows, and in part will be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to the present embodiments (exemplary embodiments), examples of which are illustrated in the accompanying drawings. Wherever possible, the same reference numbers will be used throughout the drawings to refer to the same or like parts. In the following description, reference is made to the accompanying drawings that form a part thereof, and in which is shown, by way of illustration, specific exemplary embodiments in which the present teachings may be practiced. These embodiments are described in sufficient detail to enable those skilled in the art to practice the invention and it is to be understood that other embodiments may be utilized and that changes may be made without departing from the scope of the present teachings. The following description is, therefore, merely exemplary.

Figure 1:
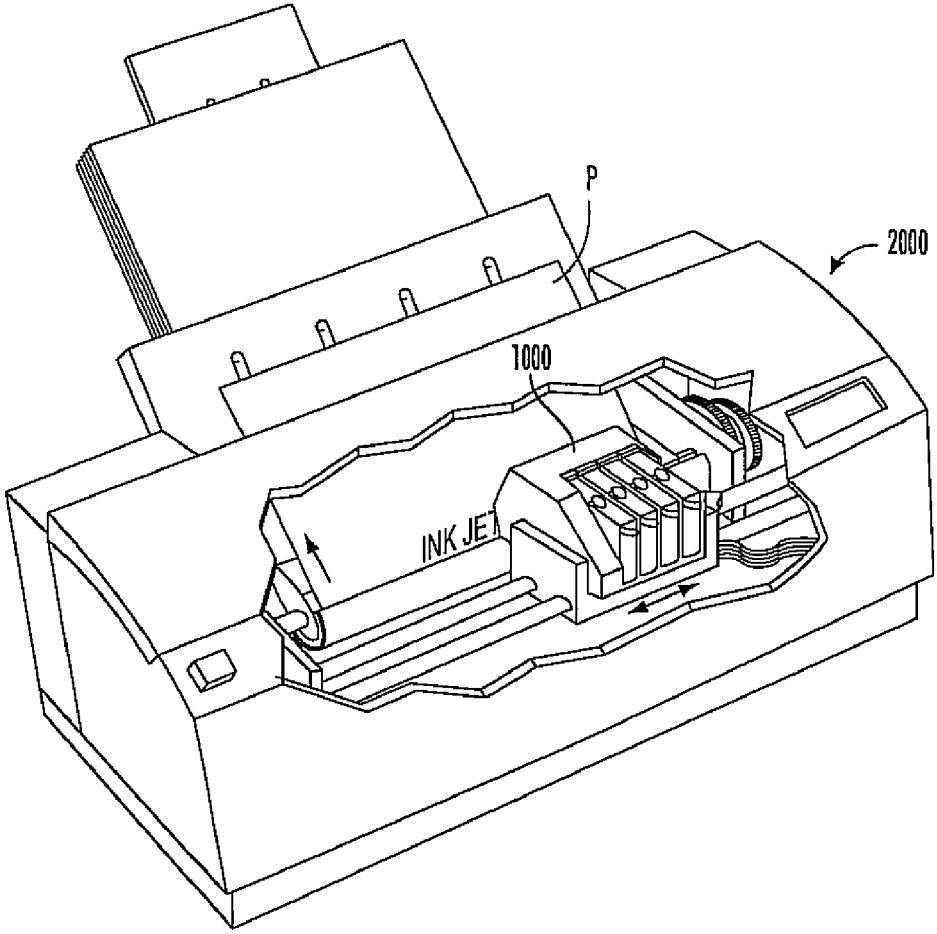
FIG. 1 is a perspective depiction of an exemplary ink jet printer in accordance with the present teachings.

FIG. 1 depicts an exemplary ink jet print printer 2000 in accordance with the present teachings. It should be readily apparent to one of ordinary skill in the art that the ink jet printer 2000 depicted in FIG. 1 represents a generalized schematic illustration and that other components can be added or existing components can be removed or modified.

As shown in FIG. 1, one or more fluid drop ejectors 1000 can be incorporated into the ink jet printer 2000, to eject droplets of ink onto a substrate P. The individual fluid drop ejectors 1000 can be operated in accordance with signals derived from an image source to create a desired printed image on print medium P. Printer 2000 can take the form of the illustrated reciprocating carriage printer that moves a printhead in a back and forth scanning motion, or of a fixed type in which the print substrate moves relative to the printhead.

The carriage type printer can have a printhead having a single die assembly or several die assemblies abutted together for a partial width size printhead. Because both single die and multiple-die partial width printheads function substantially the same way in a carriage type printer, only the printer with a single die printhead will be discussed. The only difference, of course, is that the partial width size printhead will print a larger swath of information. The single die printhead, containing the ink channels and nozzles, can be sealingly attached to a disposable ink supply cartridge, and the combined printhead and cartridge assembly is replaceably attached to a carriage that is reciprocated to print one swath of information at a time, while the recording medium is held stationary. Each swath of information is equal to the height of the column of nozzles in the printhead. After a swath is printed, the recording medium P is stepped a distance at most equal to the height of the printed swath, so that the next printed swath is contiguous or overlaps with the previously printed swath. This procedure is repeated until the entire image is printed.

Figure 2A:
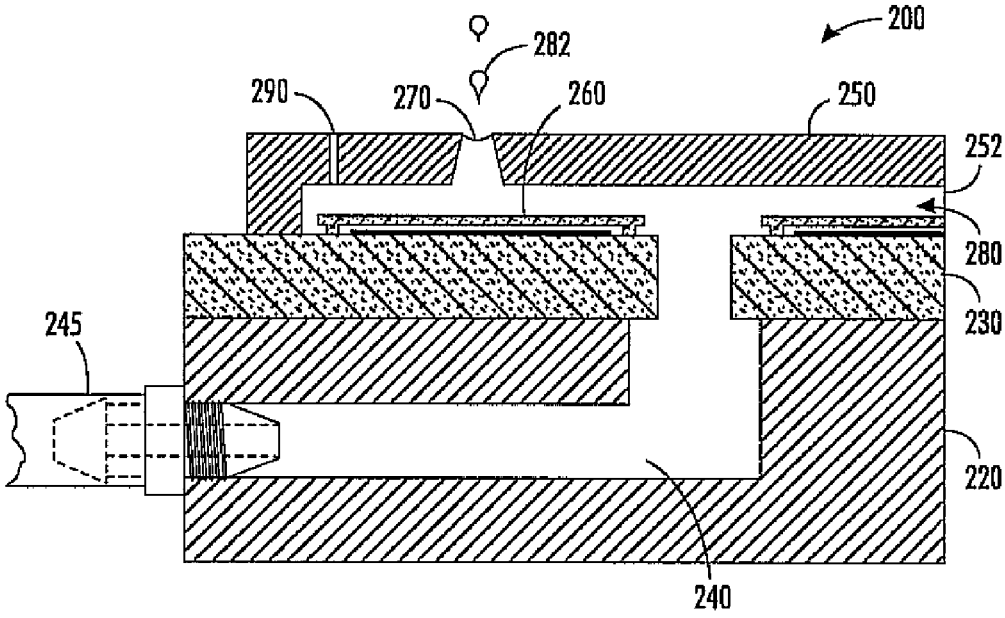
FIG. 2A is a side view of a portion of an ink jet print head configuration used in the ink jet printer of FIG. 1, in accordance with the present teachings.
Figure 2B:
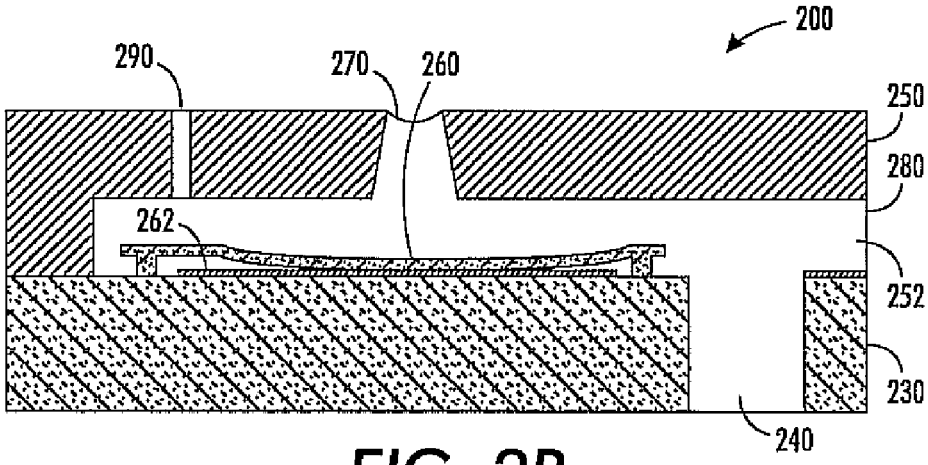
FIG. 2B is detailed side view of a portion of FIG. 2A depicting certain components of the ink jet print head in accordance with the present teachings.

FIG. 2A depicts an exemplary print head 200 and FIG. 2B depicts a more detailed view of the print head 200 of FIG. 2A, in accordance with the present teachings. The exemplary print head 200 can be used, for example, in the ink jet printer 2000 of FIG. 1. It should be readily apparent to one of ordinary skill in the art that the print head 200 depicted in FIGS. 2A and 2B represents generalized schematic illustrations and that other components can be added or existing components can be removed or modified.

As shown in FIGS. 2A and 2B, the print head 200 can be an electrostatically actuated print head. The print head 200 can include a substrate package 220, a silicon wafer 230 on an upper surface of the package substrate 220, an ink passage 240 through the package substrate 220 and wafer 230, a tube 245 connecting the ink passage 240 of the print head 200 to an ink supply reservoir, and a nozzle plate 250 mounted on the die structure. An electrostatically actuated membrane 260 can be formed on the silicon wafer 230 as shown. A nozzle hole 270 and a priming hole 290 can be formed in the nozzle plate 250. Details of the membrane 260 relative to the remaining structure are shown in further detail in FIG. 2B.

In the print head 200, the membrane 260 can be an electrostatically actuated diaphragm, in which the membrane 260 is controlled by an electrode 262. FIG. 2B depicts additional details of the electrostatically actuated diaphragm 260 in an activated state, while FIG. 2A generally depicts the membrane 260 in a relaxed state. The membrane 260 can be made from a structural material such as polysilicon, as is typically used in a surface micromachining process. Although not shown, a dimple can be attached to a part of membrane 260 and act to separate the membrane 260 from the conductor 262 when the membrane is pulled down towards the conductor under electrostatic attraction (e.g. when a voltage or current is applied between the membrane and the conductor). An actuator chamber between membrane 260 and wafer 230 can be formed using typical techniques, such as by surface micromachining. The electrode 262 acts as a counterelectrode and is typically either a metal or a doped semiconductor film such as polysilicon.

The nozzle plate 250 is located above electrostatically actuated membrane 260, forming a fluid pressure chamber 252 between the nozzle plate 250 and the membrane 260. Nozzle plate 250 has nozzle 270 formed therein. Fluid 280 is fed into this fluid pressure chamber 252 from a fluid reservoir (not shown). The fluid pressure chamber 252 can be separated from the fluid reservoir by a check valve to restrict fluid flow from the fluid reservoir to the fluid pressure chamber. The membrane 260 is initially pulled-down by an applied voltage or current. Fluid 280 fills in the volume created by the membrane deflection.

When a bias voltage or charge is eliminated, the membrane 260 relaxes, increasing the pressure in the fluid pressure chamber 252. As the pressure increases, fluid 280 is forced out of the nozzle 270 formed in the nozzle plate 250, as discrete fluid drops 282. For constant volume or constant drop size fluid ejection, the membrane 260 can be actuated using a voltage drive mode, in which a constant bias voltage is applied between the parallel plate conductors that form the membrane and the conductor.

The membrane 260 is typically formed using standard polysilicon surface micromachining, where the polysilicon structure that is to be released is deposited on a sacrificial layer that is finally removed. Electrostatic forces between deformable membrane 260 and conductor 262 deform the membrane.

Figure 3A:
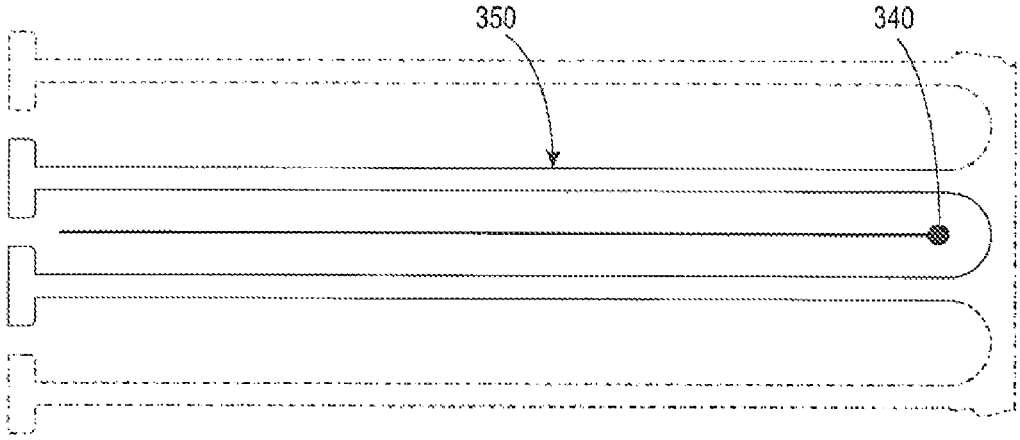
FIG. 3A is a top plan view depicting known nozzle hole placement in a nozzle plate of an ink jet print head.
Figure 3B:
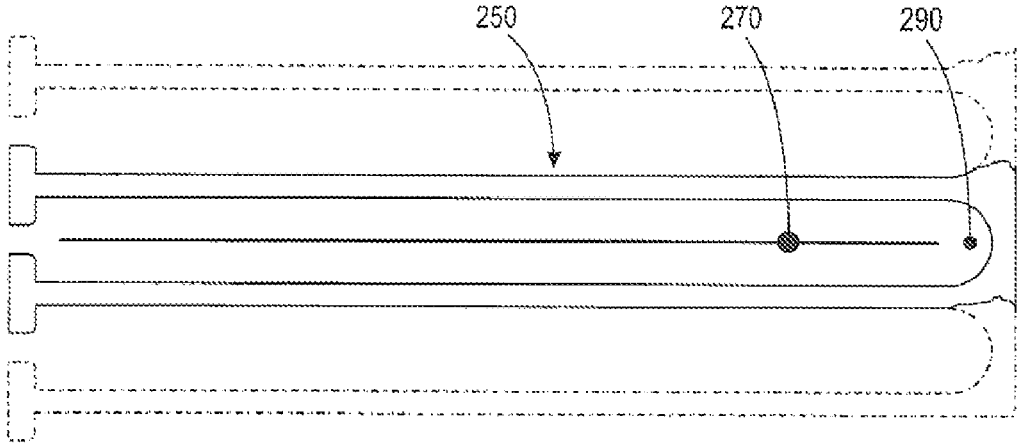
FIG. 3B is a top plan view depicting exemplary placement of a priming hole and nozzle holes in a nozzle plate incorporated in the ink jet print head of FIGS. 2A and 2B, in accordance with the present teachings.

FIG. 3A depicts a known nozzle plate 350 and FIG. 3B depicts an exemplary nozzle plate 250, in accordance with the present teachings. It should be readily apparent to one of ordinary skill in the art that the nozzle plate 250 depicted in FIG. 3B represents a generalized schematic illustration and that other components can be added or existing components can be removed or modified.

The nozzle plate 350 of FIG. 3A includes a nozzle 340. The nozzle plate 250 of FIG. 3B can include a nozzle 270 and the priming hole 290. The nozzle plate 350 of FIG. 3A is depicted to illustrate a conventional positioning of a nozzle 340. Here, the nozzle 340 is shown at the end of the nozzle plate 350, and thus substantially at an outermost end of a corresponding fluid chamber (e.g. 252 of FIGS. 2A and 2B). The nozzle 340 positioned at an end of the nozzle plate 350 can encounter the problems pointed out above, namely a non-optimal position of the nozzle holes 340 and no means other than the nozzle for purging of air or air bubbles from the fluid chamber 252.

In FIG. 3B, both the nozzle 270 and the priming hole 290 are depicted. Although only one of each a nozzle 270 and priming hole 290 are depicted, it will be appreciated that any number of such components are intended to be included within the scope of the invention. For example, the number of ink nozzle 270 in the face of the nozzle plate 250 can range from a single nozzle up to nine nozzles 270, for example, aligned in a vertical direction to provide for dot matrix printing. Further, two or more priming holes 290 can be formed in the nozzle plate 250 to purge air from the fluid chamber 252. The priming hole 290 can be configured as a reduced diameter nozzle hole. The priming hole 290 can be positioned in the corners of the nozzle plate 250, or any position suitable for enabling air to escape from the fluid chamber 252. The positioning of the priming hole 290 at, for example, an extreme end of the nozzle plate 250, can allow complete priming and eliminate any physical constraint on a position of the nozzle 270. It will be appreciated that the exemplary structure can be implemented using any printhead with silicon aperture plates.

Because the priming holes 290 are so much smaller than the nozzles 270 (ideally as small as the technology will allow), surface tension of the meniscuses is so high that the priming hole 290 will not jet or weep. The pressure at which a nozzle weeps is the inverse of the hole diameter, and the priming holes can be made to be from about 5 to about 10 times smaller than a diameter of the nozzles. Because there is little net flow through the priming holes 290 (they don't jet), they are unlikely to completely clog. However, redundant priming holes can be added as insurance.

The priming holes 290 can be made at the same time as the nozzles 270, so there is no extra cost associated with the priming holes at the manufacturing stage. Although the priming holes 290 are depicted as substantially vertical, they can also be tapered, as can occur during formation. An additional benefit is that the priming holes 290 generally make it easier to purge air out of the system, thereby decreasing the purge of ink the significant cost associated with expelling unnecessary ink. For both silicon and laser-etched nozzles, the addition of priming holes would only require an additional feature drawn on a mask.

The silicon nozzle plate 250 can include priming holes 290 having a diameter of from about 10 to about 15 μm in diameter. Priming holes 290 and nozzles 270 can be placed in many different positions along the length of the nozzle plate 250. With the one or more exemplary priming holes 290, the print head can prime easily regardless of the nozzle position and the priming holes have no impact on jetting of ink through the nozzle 270.

By way of example, moving a nozzle 270 from about 5% to about 20% away from an end of the nozzle plate 250, and therefore from an inner end of the fluid chamber 252, can cause a maximum drop speed to increase by about three times. This optimal positioning of the nozzle 270 can also cause the optimal pulse width to drop by up 2 microseconds (from 9 to 7 microseconds), allowing for higher frequency jetting of ink.

Because priming the device is achieved by the priming holes 290, the nozzle 270 can be positioned anywhere in the nozzle plate 250. For example, when there are corners in a fluid chamber 252 that gather air, large amounts of ink must be forced through the system to get enough turbulent flow to displace those air bubbles, or to dissolve the bubbles back into the ink. By allowing air to escape easily through the priming holes 290, substantially less ink will be required, reducing the purge mass and saving the customer money.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A nozzle plate for an inkjet printhead, the nozzle plate comprising:

a first end from which ink is supplied and a second end opposite the first end;

at least one nozzle hole through which ink is ejected, wherein the at least one nozzle hole opens into a fluid pressure chamber from which ink is ejected during printing; and at least one priming hole, distinct from and of a smaller diameter than the nozzle hole, wherein the priming hole opens into the fluid pressure chamber from which ink is ejected during printing, and the priming hole is positioned in the nozzle plate to purge air from the ink jet printhead substantially without expelling ink during the purge, wherein the nozzle hole is positioned between the first end and the second end of the nozzle plate and the priming hole is positioned between the nozzle hole and the second end of the nozzle plate.

2. The nozzle plate of claim 1, wherein the priming hole is positioned at an outermost usable extremity of the nozzle plate.

3. The nozzle plate of claim 1, wherein the priming hole is positioned at any location of the nozzle plate between the nozzle hole and the second end of the nozzle plate.

4. The nozzle plate of claim 1, wherein the priming hole is positioned laterally outside of a nozzle hole in the nozzle plate.

5. The nozzle plate of claim 1, wherein a diameter of the priming hole is about 5 to about 10 time less than a diameter of a nozzle hole.

6. The nozzle plate of claim 1, wherein the priming hole comprises a diameter of from about 10 to about 15 microns.

7. The nozzle plate of claim 1, further comprising multiple priming holes, wherein the multiple priming holes are positioned between the nozzle hole and the second end of the nozzle plate.

8. The nozzle plate of claim 1, further comprising, in the printhead, a substrate, an electrostatically actuated membrane formed on the substrate, and a fluid pressure chamber between the membrane and the nozzle plate.

9. An ink jet printer comprising the printhead of claim 8.

10. The ink jet printer of claim 9, comprising a roof-shooter printer.

11. A nozzle plate comprising:

a priming hole which opens into a fluid pressure chamber from which ink is ejected during printing, and the priming hole is positioned in the nozzle plate to purge air from the fluid pressure chamber within an ink jet print head substantially without expelling ink through the priming hole, wherein the priming hole is positioned in the nozzle plate between a first end of the nozzle plate from which ink is supplied during printing and a second end of the nozzle plate, and further positioned in the nozzle plate between a nozzle hole through which ink is expelled during printing and the second end of the nozzle plate.

12. The nozzle plate of claim 11, wherein the priming hole is positioned at an outermost usable extremity of the nozzle plate.

13. The nozzle plate of claim 11, wherein the priming hole comprises a diameter of from about 10 to about 15 microns.

14. The nozzle plate of claim 11, further comprising a plurality of priming holes, wherein each priming hole of the plurality of priming holes is positioned in the nozzle plate between the nozzle hole and the second end of the nozzle plate and opens into a fluid pressure chamber from which ink is eiected during printing.

15. The nozzle plate of claim 11, further comprising a substrate and an electrostatically actuated membrane formed on the substrate, wherein the fluid pressure chamber from which ink is ejected during printing is interposed between the membrane and the nozzle plate.

16. An ink jet printhead comprising the nozzle plate of claim 11.

17. The nozzle plate of claim 1, wherein the priming hole is of a diameter such that a surface tension on an ink meniscus renders the priming hole weep free.

18. The nozzle plate of claim 11, wherein the priming hole is of a diameter such that a surface tension on an ink meniscus renders the priming hole weep free.

19. A nozzle plate for an inkjet printhead, the print head comprising:

an ink channel comprising a first end connected to an ink supply and a second end opposite the first end, wherein the nozzle plate provides part of the ink channel;

at least one nozzle hole in the nozzle plate through which ink is ejected during printing, wherein the at least one nozzle hole opens into a fluid pressure chamber from which ink is ejected during printing; and at least one priming hole in the nozzle plate, distinct from and of a smaller diameter than the nozzle hole, wherein the priming hole opens into the fluid pressure chamber from which ink is ejected during printing, and the priming hole is positioned in the nozzle plate to purge air from the ink jet printhead substantially without expelling ink during the purge, wherein the nozzle hole is positioned along the ink channel between the first end of the ink channel and the second end of the ink channel and the priming hole is positioned along the ink channel between the nozzle hole and the second end of the ink channel.

* * * * *